US006544154B2

(12) United States Patent
Forcillo

(10) Patent No.: US 6,544,154 B2
(45) Date of Patent: Apr. 8, 2003

(54) VARIABLE RESISTANCE ABDOMINAL BENCH

(76) Inventor: John Forcillo, 164 St-Louis, St-Eustache, Quebec (CA), J7R 1Y3

( * ) Notice: Subject to any disclaimer, the term of this patent is extended or adjusted under 35 U.S.C. 154(b) by 0 days.

(21) Appl. No.: 09/854,444

(22) Filed: May 14, 2001

(65) Prior Publication Data

US 2002/0169057 A1 Nov. 14, 2002

(51) Int. Cl.[7] ..... A63B 26/00
(52) U.S. Cl. ..... 482/142; 482/908; 482/140
(58) Field of Search ..... 482/142, 93–96, 482/100–101, 907–908, 140, 141

(56) References Cited

U.S. PATENT DOCUMENTS

| | | | | |
|---|---|---|---|---|
| 4,240,626 A | | 12/1980 | Lambert | 272/118 |
| 4,582,319 A | | 4/1986 | Luna | 272/136 |
| 4,627,619 A | | 12/1986 | Rockwell | 272/134 |
| 5,106,079 A | * | 4/1992 | Escobedo et al. | 482/97 |
| 5,462,510 A | | 10/1995 | Ish | 482/142 |
| 5,769,766 A | * | 6/1998 | Huang | 482/140 |
| 5,993,360 A | * | 11/1999 | Stevens | 482/104 |
| 6,090,021 A | * | 7/2000 | Flowers et al. | 482/104 |
| 6,168,557 B1 | * | 1/2001 | Liao | 482/140 |
| 6,264,586 B1 | * | 7/2001 | Webber | 482/104 |
| 6,287,243 B1 | * | 9/2001 | Isom et al. | 482/142 |

* cited by examiner

*Primary Examiner*—Nicholas D. Lucchesi
*Assistant Examiner*—Lori Baker Amerson
(74) *Attorney, Agent, or Firm*—Don W. Weber

(57) ABSTRACT

A variable resistance abdominal bench is presented which has adjustable feet and handles. The adjustable feet and handles allow the bench to be adjusted to the size of the particular user of the equipment. The bench also has a torso part and a seat part. The torso and seat parts are pivotable. Attached to the torso part of the bench is a weight that slides along a track underneath the torso part. The weight can be placed on either side of the pivot point so that a negative or positive resistance can be created. The exerciser thus has the option of doing an assisted sit-up or doing a sit-up against an added weight.

6 Claims, 7 Drawing Sheets

FIG. 7
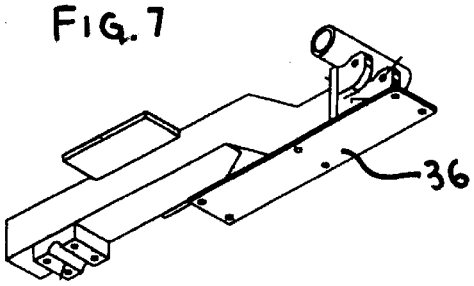
FIG. 5
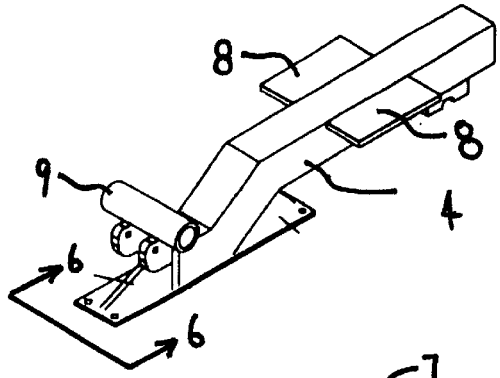
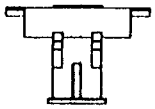
FIG. 6
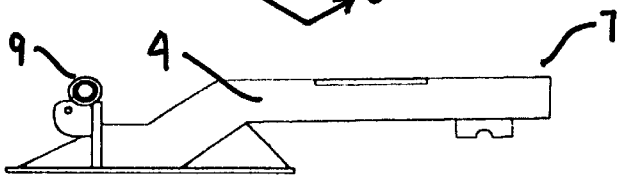
FIG. 4
FIG. 8
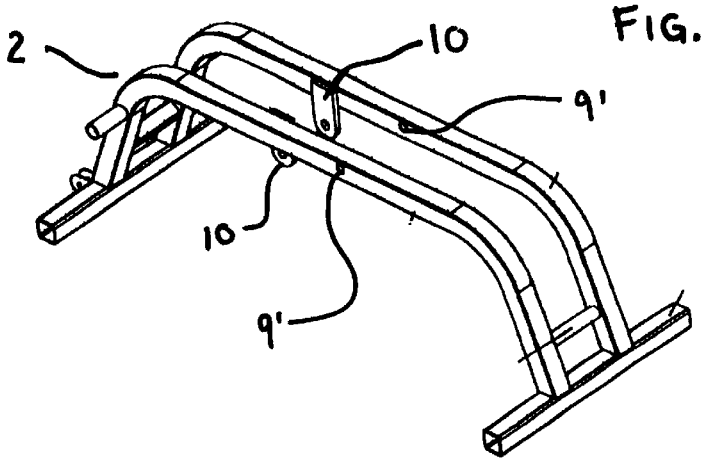

FIG. 12
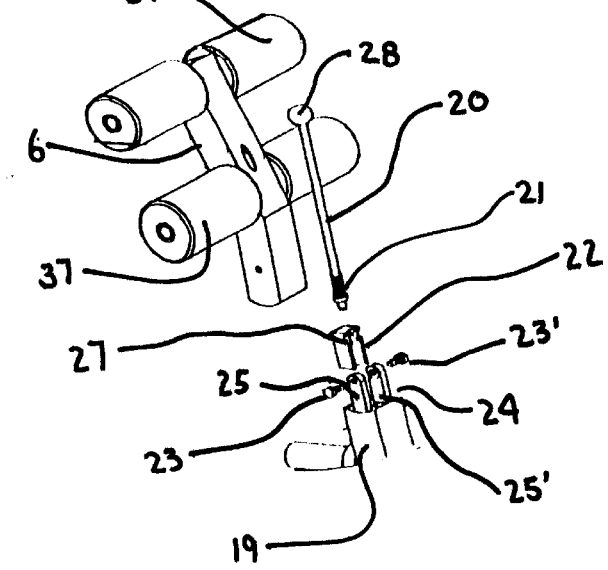
FIG. 12A
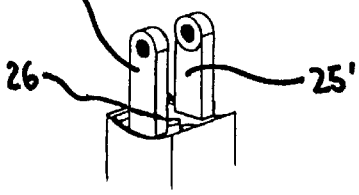
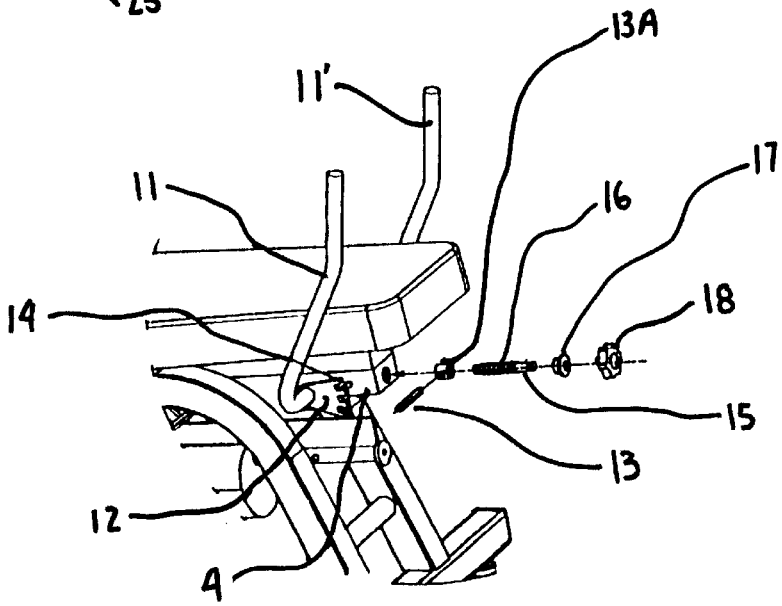
FIG. 11

VARIABLE RESISTANCE ABDOMINAL BENCH

BACKGROUND OF THE INVENTION

This invention relates to the field of exercise equipment. More particularly, a variable resistance abdominal bench is presented which has adjustable handles and foot pads as well as an adjustable resistance for sit-ups.

The physical exercise equipment field has grown much larger over the last decades. Exercise equipment is now produced to exercise virtually every part of the body and every muscle. This exercise equipment has evolved from simple weight lifting barbells to more sophisticated equipment such as exercise bicycles and full body exercise stations. Many examples of these variations of weight training exercise equipment can be found in the prior art.

This particular invention relates to sit-ups, an exercise that primarily exercises and tones the abdominal muscles.

One type of common abdominal exercise device is found in the 1986 patent issued to Rockwell. This patent, U.S. Pat. No. 4,627,619, involves a device to exercise the abdominal muscles and back. The device is basically a passive exercise device in that no weights other than the user's body weight are built into the equipment. It is an object of this invention to provide an abdominal exerciser utilizing weights in addition to the normal body weight.

Various complicated machinery exists to exercise numerous parts of the body, including the abdominal muscles. One such abdominal waist machine is found in the 1980 U.S. Pat. No. 4,240,626 issued to Lambert. In the Lambert device, abdominal exercise motions are developed by working against weights which are ultimately transferred from the back of the knee to exercising muscles throughout the groin and abdomen. The Lambert device is of general interest in the field in that it discloses an exercise bench utilizing variable resistance weights to incrementally increase the work done in the exercise. However, Lambert does not disclose an abdominal bench which provides both negative and positive weight resistance for abdominal exercise purposes. It is another object of this invention to provide an abdominal exercise bench which supplies an increased and a lessened resistance to the sit-up for incrementally increasing the exercise resistance.

Standard exercise benches exist which are designed to pivot near the waist area of the user. One such device is found in the 1995 U.S. Pat. No. 5,462,510 issued to Ish. The Ish single effort double action exercise bench pivots near the center. Ish also has stationary footrests provided so that the exercise can be accomplished. However, Ish is basically a one-size fits all bench in that the footrest is not adjustable. Additionally, Ish does not provide any handles for the arms and hands. It is a still further object of this invention to provide a pivotable abdominal bench having adjustable foot rests and handles so that the bench can be adapted to different sizes of users.

The instant device discloses a pivotable abdominal bench which provides lessened or increased resistance while exercising. There are numerous devices which direct themselves to the field of providing incrementally increased resistance when doing abdominal sit-ups. One device is disclosed in the 1986 patent issued to Luna. This patent, U.S. Pat. No. 4,582,319 provides an inclined surface upon which the exerciser sits. A strap is then placed around the exerciser's shoulder. The abdominal sit-up is then conducted against a spring tension. This spring tension provides added resistance to the abdominal exercise.

All of these previous patents lack one important feature, that being the capability of providing negative resistance to the sit-up. Negative resistance would aid the exerciser in doing the sit-up whereas positive resistance requires more effort to complete the sit-up. Furthermore, most of the previous abdominal benches do not provide adjustable handles or adjustable foot rests. It is a still and further object of this invention to provide a pivotable abdominal bench which has both adjustable handles and foot rests and which also provides either negative or positive incremental resistance for the abdominal exercise.

Other and further objects of this invention will become apparent upon reading the below described Specification.

BRIEF DESCRIPTION OF THE INVENTION

A variable resistance abdominal bench is presented which has a lower base and an upper pivotable seat and torso portion. The seat portion also has a foot rest which may be adjusted to the size of the exerciser. The torso portion has left and right handles which may be adjusted according to the size of the exerciser. Also attached to the torso portion of the device is a weight which slides along a track located near the pivot. The weight may be placed such that it provides negative, neutral or positive resistance to the torso portion of the bench during exercise.

BRIEF DESCRIPTION OF THE DRAWINGS

FIG. 4 is a side view of the pivotable torso support piece of the abdominal bench.

FIG. 5 is a perspective view of the pivotable torso support piece shown in FIG. 4.

FIG. 6 is a front view of the pivotable torso support piece in FIG. 5, taken along lines 6—6 of FIG. 5.

FIG. 7 is a perspective view of the pivotable torso support from below.

FIG. 8 is a perspective view of the lower main frame of the abdominal bench.

FIG. 11 is an exploded perspective view of the torso end of the abdominal bench showing the adjustable handle mechanism.

FIG. 12 is an exploded perspective view of the leg and foot support end of the abdominal bench.

FIG. 12A is an enlarged perspective view of the adjustable leg support block shown in FIG. 12.

DETAILED DESCRIPTION OF THE PREFERRED EMBODIMENT

Figure 1:
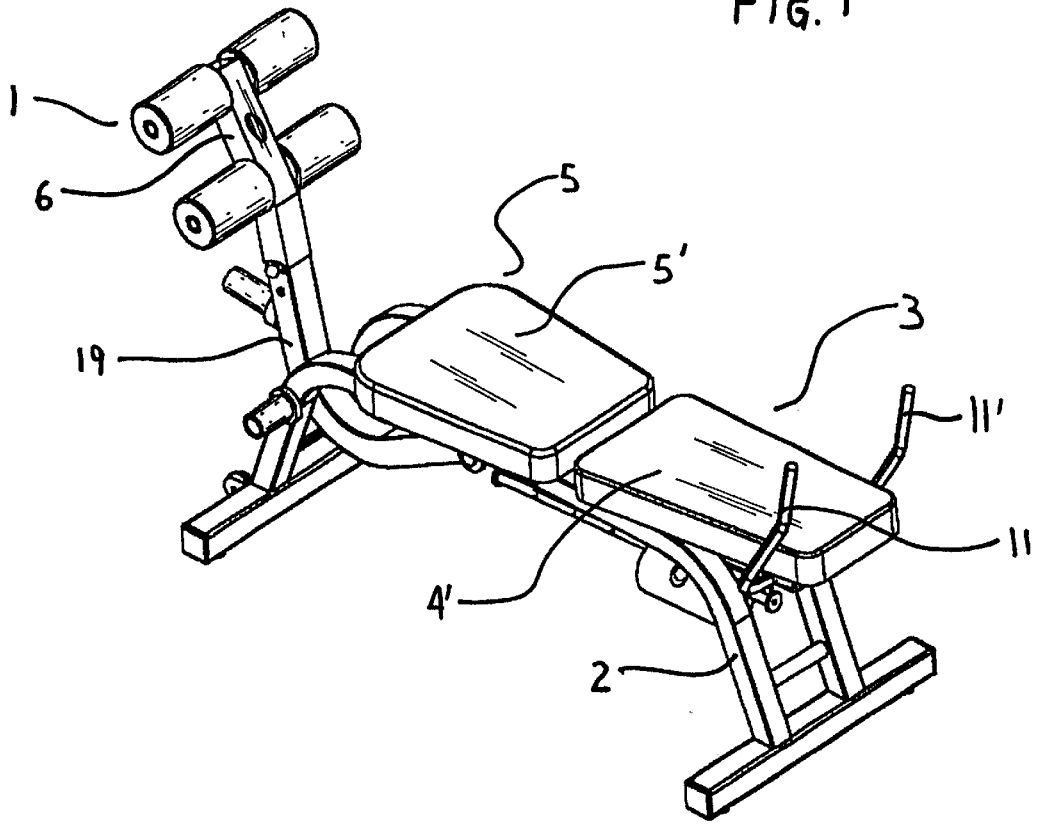
FIG. 1 is a perspective view of the variable resistance abdominal bench.
Figure 2:
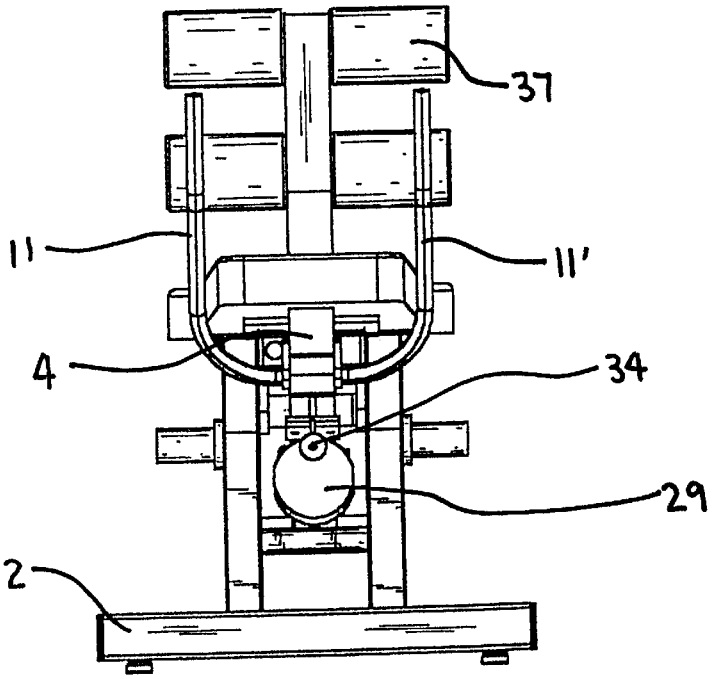
FIG. 2 is a torso end view of the abdominal bench shown in FIG. 1.

The abdominal bench of the present invention is shown in FIG. 1. Generally, the abdominal bench has a lower frame, cushions, and a leg support. The instant invention differs from the standard abdominal benches in at least three main aspects, to be described herein.

Figure 3:
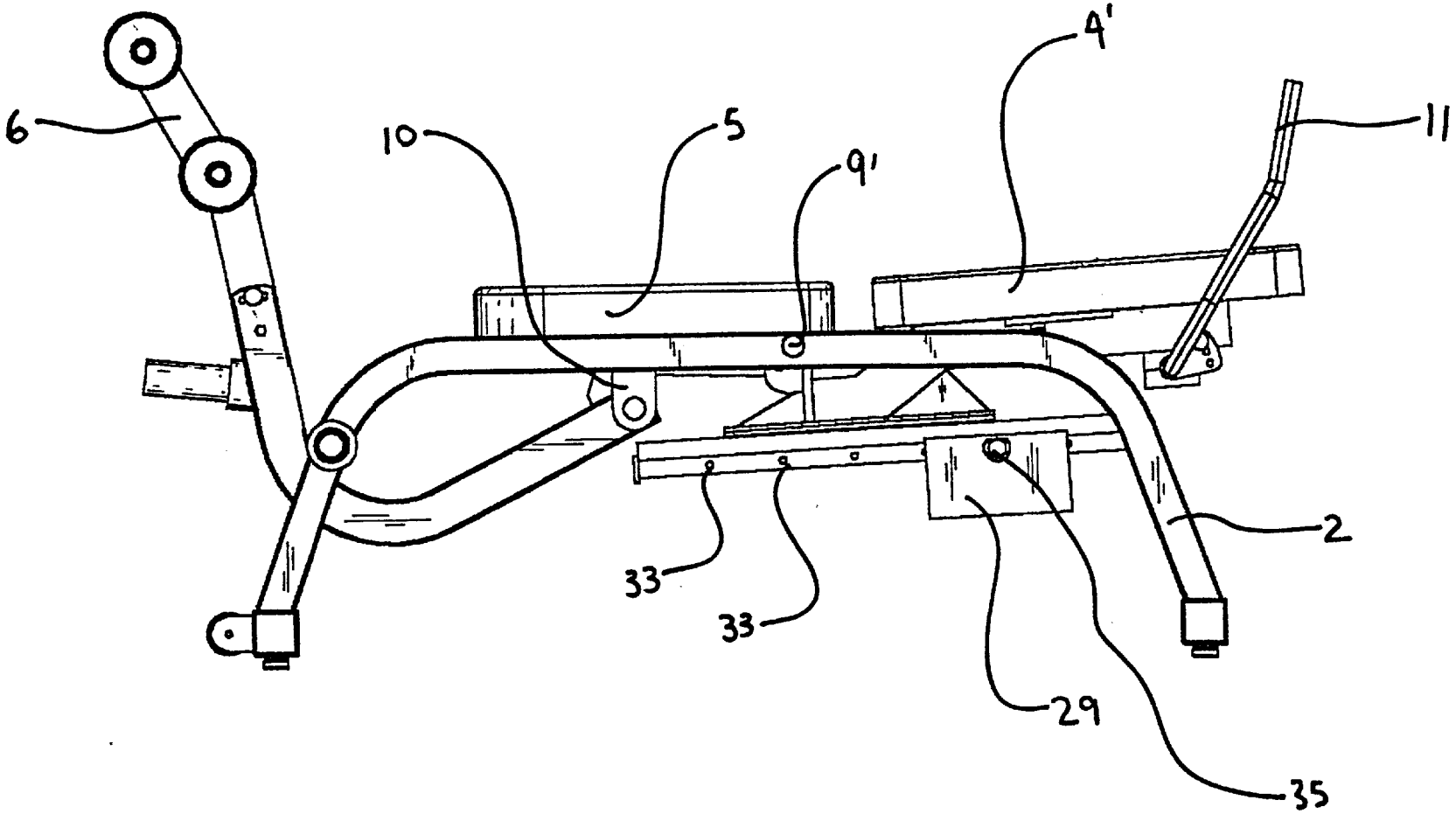
FIG. 3 is a side view of the abdominal bench shown in FIG. 1.

The variable resistance bench 1, as best shown in FIG. 1, includes a lower main frame 2, as best shown in FIGS. 1, 3 and 8. The lower main frame 2 supports the front torso section 3. As best shown in FIGS. 1 and 5, the front torso section 3 of the instant invention includes a torso support 7 (as shown in FIGS. 4 through 7) which supports a torso cushion 4'.

As shown on FIG. 1, this front torso section 3 is adjacent to a seat section 5, which is also supported by the lower main frame. Attached at the seat section 5 is a seat cushion 5'. The seat cushion 5' is attached to the lower main frame 2 by bolts or other familiar attaching means.

The variable resistance bench 1 also has an adjustable leg support system 6.

Figure 9A:
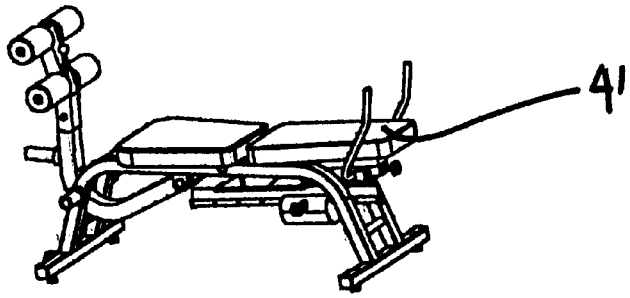
FIGS. 9A, 9B and 9C are perspective views of the abdominal bench showing how the torso section pivots upward during a sit-up.
Figure 9B:
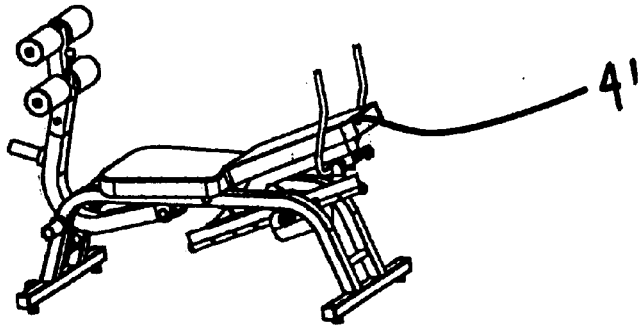
Figure 9C:
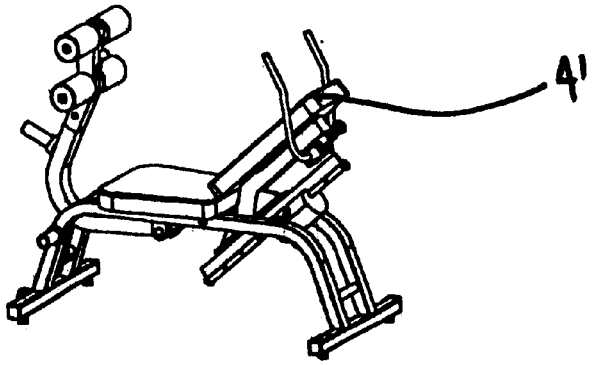

The front torso section 3 pivots upwardly, as shown in FIGS. 9A, 9B, and 9C. The torso support 7 has at one end a torso support pivot cylinder 9, and at the other end a cushion supporting member 4, as best shown in FIGS. 4 and 5. The torso support 7 is pivotably attached to the upper portion of the main frame 2 about torso support pivot holes 9'. The cushion supporting member 4 has torso cushion plates 8. The torso cushion 4' is attached to the torso cushion plate 8 by screws or other familiar fastening means. With the torso support 7 and cushion 8 pivotably attached to the lower main frame 2, the torso section 3 may pivot in the fashion as shown consecutively in Drawing FIGS. 9A, 9B, and 9C.

Also attached to the lower main frame 2 are leg supports 10 as best shown in FIG. 8. The foot main lever tube 19, as best shown in FIG. 12, is attached to the leg supports 10 as best shown in FIGS. 3 and 8.

Also attached to the front torso section 3 of the bench are left 11 and right 11' adjustable handles. One unique aspect of this invention is the adjustability of the handles, 11 and 11'. As best shown in FIG. 11, the handles are adjustable to three different angles relative to the torso support. The angle settings are determined by two slotted plates 12 located on each side of the cushion supporting member 4 of the torso support bar 7. The angle setting is locked in place by a handle pin 13 that slides into a guided slot 14 in the cushion supporting member. A pin holder 13A as shown in FIG. 11, slides over the handle-adjusting pin 13 so that the pin holder 13A is in the longitudinal middle of the pin 13. A rod 15 then secures the pin holder 13A in place when it is screwed into the pin holder 13A. The locking pin 13 is biased towards the leg support section 6 of the device. The locking pin 13 slides in the slots 14. The locking pin, being biased forward by the spring 16, thus holds the slotted plates 12 in position. The spring 16 is compressed by the screw plug 17, which is in turn fastened to the rod 15 by the handle adjustment knob 18.

The handles 11 are maintained at a set angle by pulling the knob 18, which in turn releases the locking pin 13 from the slotted plates 12. The handles 11 and 11' may thus be adjusted to the athlete's size and preferences while using the variable resistance abdominal bench.

Turning next to FIGS. 12 and 12A, the adjustable leg and foot lever mechanism is shown. The leg lever mechanism allows for three different angle setting relative to the seat section. The leg lever mechanism includes a block 24 with two extending tabs 25 and 25'. These tabs are permanently attached to the main foot lever tube 19. The extending tabs both have tapped holes forming the axis of the adjustable leg and foot lever 6. The adjustable support block 22 has deep holes with a flat bottom that constrain a biasing spring 21. This biasing spring keeps pressure on the locking pin 20 such that the locking pin remains locked in the leg adjustment holes 26. These leg adjustment holes are shown on FIG. 12A.

The adjustable support block 22 is held in place by two screws 23 having a precise diameter such that the support block 22 slides with a very small tolerance in the block pivot holes 27. The support block 22 slides tightly in the adjustable leg lever 20 and is locked in place by the two screws 23. By pulling upwards on the leg lever knob 28, the adjustable leg lever 6 can be adjusted to various angles as desired. One unique feature of this invention is the adjustability of the leg and foot support 6.

Figure 13:
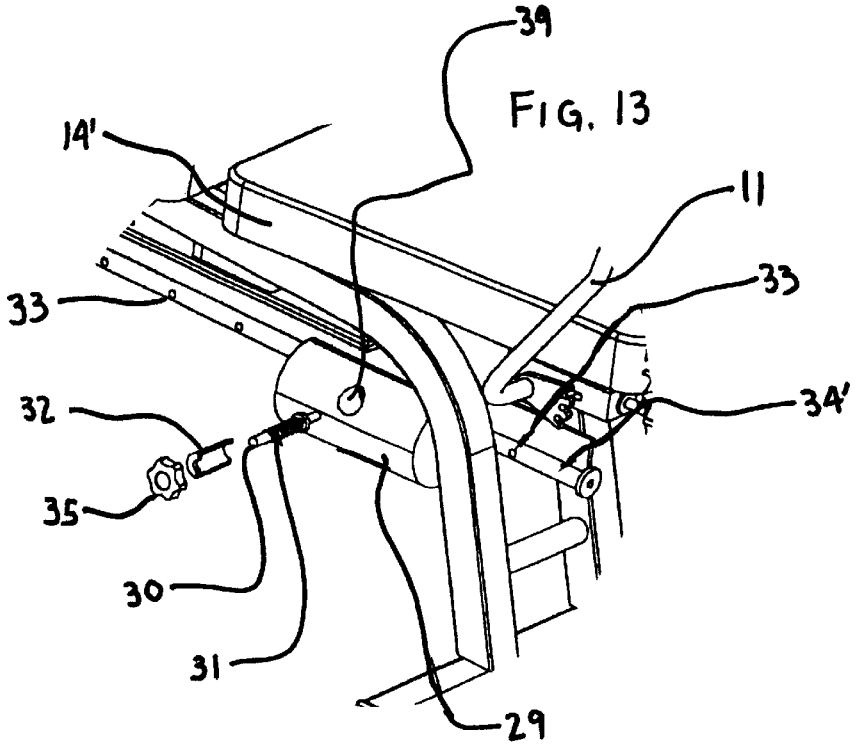
FIG. 13 is a partial exploded perspective view of the abdominal bench showing the weight, weight slide shaft and weight locking mechanism.
Figure 13A:
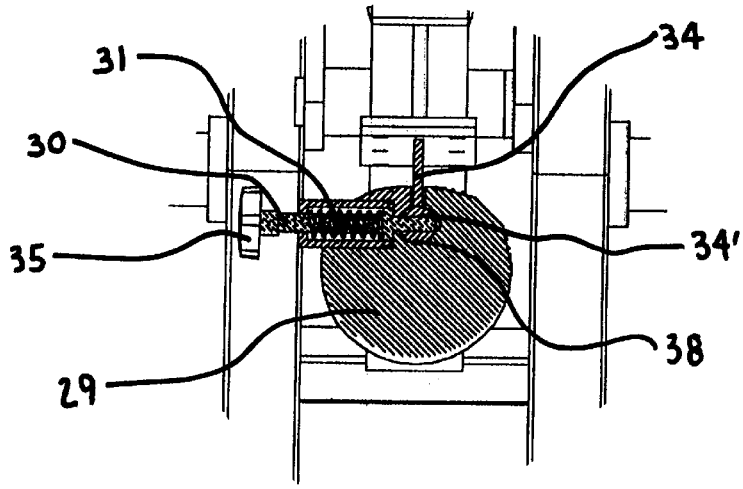
FIG. 13A is an end cutaway view of the weight, weight shaft and weight locking mechanism shown in FIG. 13.

A final and most important feature of this invention is the provision for a variable load resistance. This variable load resistance provides the athlete with three different settings for adjusting the amount of exertion required to do a sit-up or body crunchy on the abdominal bench. This unique variable load resistance system is best shown in FIGS. 13 and 13A.

A weight 29 is adjustably and slidably attached to the pivotable torso support 7. A weight slide shaft 34 is attached to the torso support 7. The weight 29 has a shaft 38 non-symmetrically located along its longitudinal length as best shown in 13A. The bottom portion 34' of the weight slide shaft 34 is rounded as shown in FIGS. 13 and 13A. The weight 29 is adjustably and slidably attached to the weight slide shaft 34 when the rounded portion of the weight slide shaft 34 is inserted into the longitudinal shaft 38 of the weight 29. This longitudinal shaft 38 is located in the upper portion of the cross section of the weight 29, as shown in FIG. 13A.

The weight 29 is locked in place at a desired setting along the length of the weight slide shaft 34 by a locking pin 30. This locking pin 30 is biased towards the weight slide shaft 34 by a weight biasing spring 31. The locking pin 30 and the biasing spring 31 are guided by a socket 32.

The lower cylindrical portion 34' of the weight slide shaft 34 also has weight slide locking holes 33. These locking holes 33 and are spaced at regular intervals along the longitudinal length of the weight slide shaft 34. Once the weight 29 is located at a desired position along the longitudinal length of the weight slide shaft 34, the weight locking pin 30 is pushed through a small hole 39 located in the weight. The locking pin 30 has a weight adjustment knob 35. By pulling the weight adjustment knob 35, and hence the locking pin 30, away from the weight slide shaft 34, the weight 29 is free to move along the longitudinal length of the shaft. However, when the knob 35 is released, the biasing spring 31 pushes the pin 30 through the weight hole 39 and locks the weight 29 in place when the inner tip of the locking pin 30 is inserted through one of the weight slide locking holes 33, as best shown in FIG. 13A.

Figure 10A:
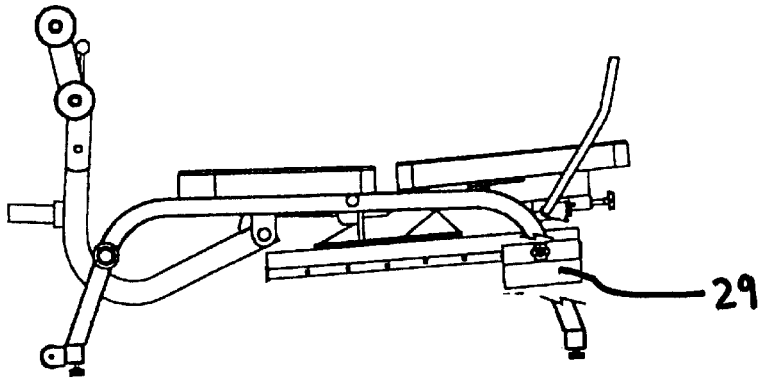
FIGS. 10A, 10B and 10C are side views of the abdominal bench showing the various locations of the adjustable weight.
Figure 10B:
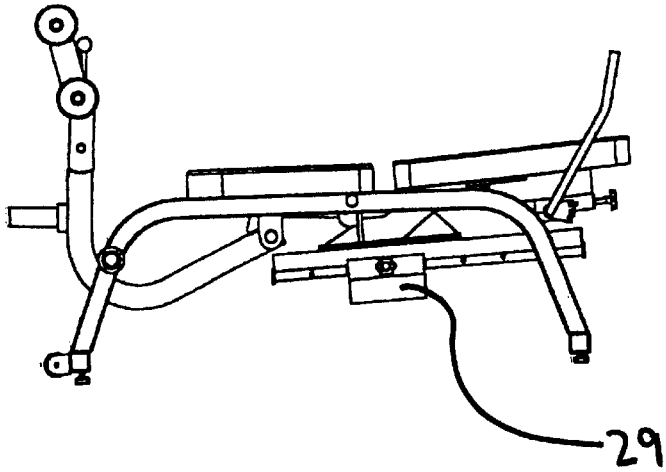
Figure 10C:
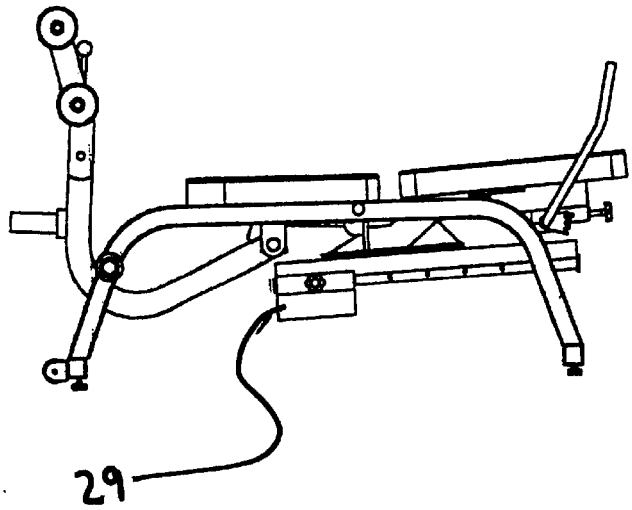

In this simple manner, the variable load resistance system can be adjusted to either increase or decrease the weight load required to do a sit-up by easily moving the weight 29 forward or backward to different resistance settings. This different resistance settings are best shown in FIGS. 10A, 10B and 10C. The weight 29 may be adjusted such that the weight is positioned on either side of the torso pivot point 9'. Locating the weight in the handle side of pivot point 9' provides positive resistance; locating the weight on the foot side of pivot point 9' provides negative resistance.

This variable resistance abdominal bench enables a user to shift easily to a ten percent (10%) negative resistance (FIG. 10C) which has the effect of "reducing" the user's body weight so that upward movement becomes easier to perform. As one slides the weight block towards the handles of the device, the resistance can be increased up to a maximum load of 45 pounds. As shown in FIG. 10A, this maximum load would increase the resistance required to do a sit-up. As shown in FIG. 10B, the weight can also be adjusted such that it will have no impact on the resistance (either negative or positive) of the device.

Also attached to the torso support 7, as best shown in FIG. 7, is a weight plate holder 36. The plate holder is installed for the super athlete who might need a great deal of additional weight in addition to the maximum setting of the weight 29 as shown in FIG. 10A. Although this weight plate would only be necessary in less than one percent of the athletes using this variable resistance abdominal bench, it has also been included as an added feature of this device.

Foot and ankle pads 37 are also attached to the adjustable leg support 6, as shown in the Drawing Figures. These foot and ankle pads are standard for most abdominal or other exercise benches.

The means for adjusting the handles disclosed herein are preferred, as is the means for adjusting the angle of the foot and leg support. Further, the means for sliding the weight along the torso section is also preferred. However, other means for adjusting the handles and foot and leg support, as well as for locating the weight along the longitudinal axis of the torso support may be utilized while still keeping within the spirit and disclosure of the invention.

Having fully described my invention I claim:

1. A variable resistance abdominal bench for sit-ups comprising:

(a) a lower main frame supporting a front torso section and a seat section;

(b) a pivotable front torso section attached to said frame at a torso pivot point having at least one handle attached thereto;

(c) a seat section attached to said lower main frame having a leg and foot support attached thereto;

(d) a weight, adjustably attached to the bottom of said torso section such that said weight may be positioned on either side of said torso pivot point, wherein the location of said weight in relation to said torso pivot point increases or decreases the weight load required to do a sit-up.

2. A variable resistance abdominal bench as in claim 1, wherein said handles may be adjusted to angles relative to said torso support.

3. A variable resistance abdominal bench as in claim 1, wherein said leg and foot support may be adjusted to different angles relative to said seat support.

4. A variable resistance abdominal bench for sit-ups, comprising:

(a) a lower main frame supporting a front torso section and a seat section;

(b) a pivotable front torso section attached to said frame at a torso pivot point having at least one handle attached thereto;

(c) a seat section attached to said lower main frame having a leg and foot support attached thereto;

(d) a weight slide shaft attached to the bottom of said torso section, wherein said torso pivot point is located between the ends of said slide shaft; and (e) a weight locking means to position said weight at a location along said shaft, wherein the location of said torso pivot point increases or decreases the weight load required to do a sit-up.

5. A variable resistance abdominal bench for sit-ups as in claim 4, wherein said handles may be adjusted to different angles relative to said torso support.

6. A variable resistance abdominal bench for sit-ups as in claim 4, wherein said leg and foot support may be adjusted to different angles relative to said seat support.

* * * * *